12/9/80 XR 4,238,136

United States Patent [19]

Ricketts

[11] 4,238,136

[45] Dec. 9, 1980

[54] FORMATION OF IN SITU OIL SHALE RETORT WITH VOID AT THE TOP

[75] Inventor: Thomas E. Ricketts, Bakersfield, Calif.

[73] Assignee: Occidental Oil Shale, Inc., Grand Junction, Colo.

[21] Appl. No.: 52,520

[22] Filed: Jun. 27, 1979

[51] Int. Cl.[3] ..... E21C 41/10

[52] U.S. Cl. ..... 299/2; 299/13; 166/259

[58] Field of Search ..... 299/2, 13; 166/259

[56] References Cited

U.S. PATENT DOCUMENTS

| | | | |
|---|---|---|---|
| 2,481,051 | 9/1949 | Uren | 299/2 |
| 4,153,300 | 5/1979 | Kvapil et al. | 299/2 |
| 4,162,808 | 7/1979 | Kvapil et al. | 299/2 |
| 4,167,213 | 9/1979 | Stoltz et al. | 299/2 |

*Primary Examiner*—Ernest R. Purser

*Attorney, Agent, or Firm*—Arnold Grant

[57] ABSTRACT

A method of forming an in situ oil shale retort with an open space or inlet plenum void between the top boundary of the fragmented permeable mass of oil shale particles and the unfragmented formation above the retort. The method comprises excavating at least one horizontal void in the formation, placing explosive into the unfragmented formation above and below the void, and then explosively expanding formation above the void prior to explosively expanding formation below the void. The additional time for expansion of formation above the void, as compared with that below the void, permits non-uniform expansion and leaves an open space over the top of the fragmented mass.

11 Claims, 3 Drawing Figures

FORMATION OF IN SITU OIL SHALE RETORT WITH VOID AT THE TOP

BACKGROUND OF THE INVENTION

This invention relates to in situ recovery of shale oil, and more particularly, to techniques for forming an in situ oil shale retort with an open space or inlet plenum void between the top boundary of the fragmented permeable mass of oil shale particles in the retort and the unfragmented formation above said retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is instead a sedimentary formation comprising marlstone deposit interspersed with layers containing an organic polymer called "kerogen." The kerogen, upon heating, decomposes to produce liquid and gaseous hydrocarbon products. It is the formation containing kerogen that is called "oil shale" herein, and the liquid hydrocarbon product is called "shale oil."

A number of methods have been proposed for processing oil shale which involve either first mining and processing the shale on the surface or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596,4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting, gases are passed through the fragmented mass to convert kerogen contined in the oil shale to liquid and gaseous products, thereby producing retorted oil shale. One method of supplying hot retorting gases used for converting kerogen contained in the oil shale includes establishing a combustion zone in the retort and introducing an oxygen-suppling retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone and from carbonate decomposition, gaseous products produced in the retorting zone, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids are initially excavated one above another within the retort site. A plurality of vertically spaced apart zones of unfragmented formation are temporarily left between the voids. Explosive is placed in each of the unfragmented zones and detonated to explosively expand each unfragmented zone into the voids on either side of each unfragmented zone to form a fragmented mass having a void volume substantially corresponding to the void volume of the initial voids. Retorting of the fragmented mass is then carried out to recover shale oil from the oil shale.

It is desirable to establish a combustion zone which is relatively flat and extends laterally across the entire fragmented permeable mass. The relatively flat combustion zone extending laterally across the entire fragmented permeable mass enables retorting of a maximum volume of the fragmented permeable mass of oil shale which, in turn, tends to maximize the yield of liquid and gaseous products from the in situ oil shale retort.

In practice, the combustion zone is created by using one or more burners to ignite a portion or portions of the fragmented permable mass. The burner is ignited and the flame from the burner is directed toward the fragmented permeable mass to heat an upper portion of the fragmented permeable mass to greater than the self ignition temperature of carbonaceous material in the oil shale. The burner is then withdrawn from the retort and fuel and an oxygen-containing gas are introduced to spread the primary combustion zone laterally. Some difficulty has been encountered in causing a combustion zone to spread laterally near the top of an in situ oil shale retort where the fragmented mass completely fills the retort cavity. Thus, considerable time and fuel can be consumed in causing the combustion zone to spread laterally to a sufficient extent to recover shale oil from some of the upper portions of the fragmented mass. Previous techniques have caused the combustion zone to propagate downwardly a considerable distance as it spreads laterally, the downward and radial distance being about the same. This can cause bypass of oil shale in the upper corners of the retort and/or some of the shale oil produced in the upper portions of the fragmented permeable mass to pass through downstream portions of the primary combustion zone thereby being consumed. The consumption of shale oil or the complete bypassing of portions of the oil shale tends to reduce the yield of shale oil from the retorting operation. It is therefore desirable to have a technique for improving the rate and extent of lateral spreading of the combustion zone near the top of the retort.

SUMMARY OF THE INVENTION

A method of improving the rate and extent of lateral spreading of the primary combustion zone is suggested in U.S. application Ser. No. 35,930 in the name of Chang Yul Cha, the disclosure of which is incorporated herein by this reference. Briefly, the invention therein is using a retort which has an open space between the top boundary of the fragmented permeable mass in the retort and the unfragmented formation above said retort. This open space acts as a plenum which permits uniform gas distribution over the top of the fragmented permeable mass and enhances the later propagation of the combustion zone.

An in situ retort with an inlet plenum void or open space extending substantially across the upper surface of the retort intermediate the top boundary of fragmented permeable mass and the unfragmented formation above said retort can be formed in horizontal free face retorts by explosive expansion of unfragmented formation into the uppermost excavated void in a time delay sequence. More specifically, the sequence involves explosively fragmenting the formation above the excavated void prior to explosively fragmenting formation below the excavated void. The additional time for expansion of formation above the void, as compared with that below the void, permits non-uniform expansion and leaves an open space over the top of the fragmented mass. The exact time interval between detonation of the formation above the void and formation below the void can be calculated, according to known techniques, and is dependent upon the kind of explosive being used and the spacing and depth of burial of the explosive.

BRIEF DESCRIPTION OF THE DRAWINGS

These and other aspects of the invention will be more fully understood by referring to the following detailed description and the accompanying drawings in which.

DETAILED DESCRIPTION

The present invention provides for a retort for recovery of liquid and gaseous hydrocarbon products from a subterranean formation containing oil shale. The retort is formed with an inlet plenum void or open space across substantially the entire fragmented permeable mass between the upper surface of the fragmented permeable mass and the unfragmented formation above said fragmented mass.

Figure 1:
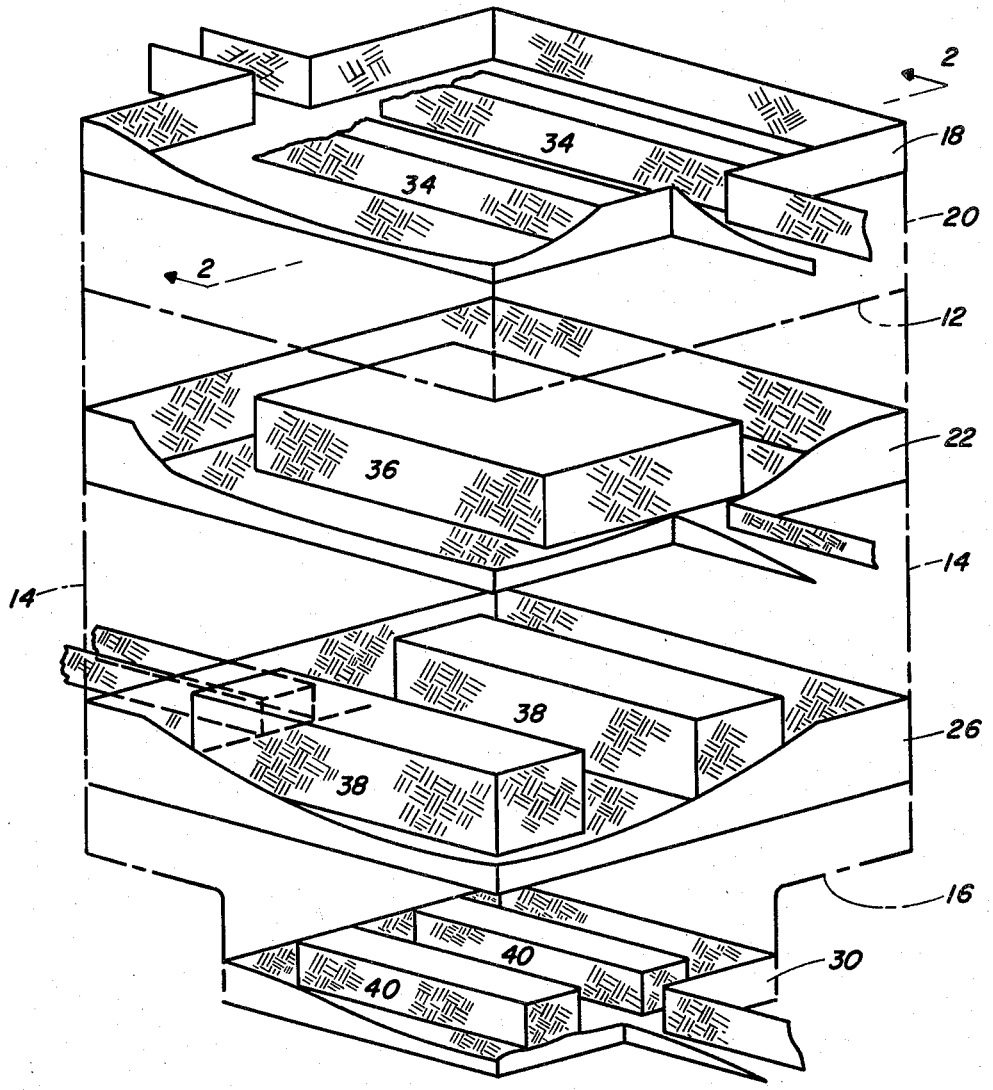
FIG. 1 is a fragmentary, semi-schematic perspective view showing a subterranean formation containing oil shale prepared for explosive expansion for forming an in situ oil shale retort.
Figure 2:
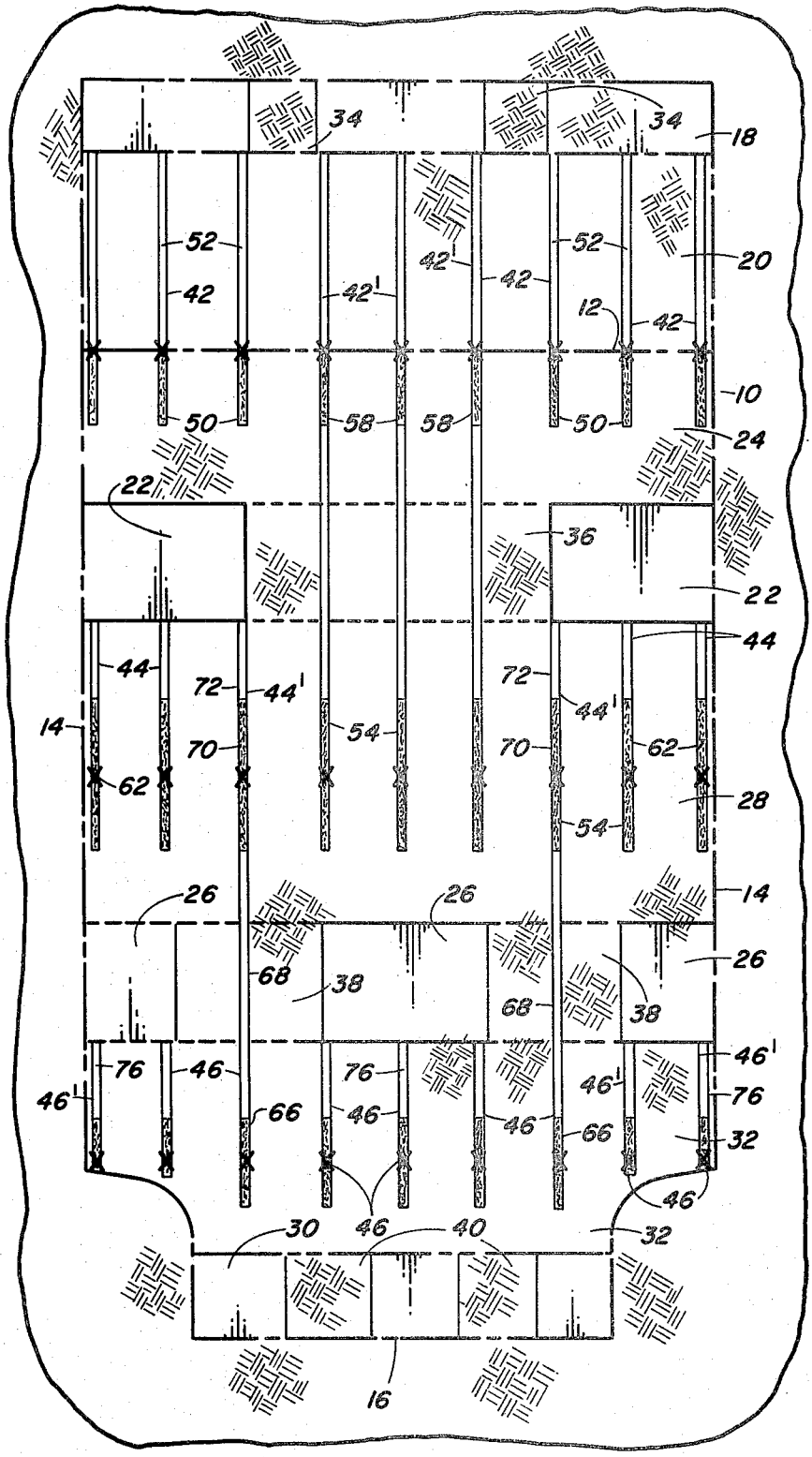
FIG. 2 is a fragmentary, semi-schematic vertical cross-section view taken on line 2—2 of FIG. 1.

FIGS. 1 and 2 schematically illustrate as in situ retort being formed in a subterranean formation containing oil shale in accordance with principles of this invention. The in situ retort has a top boundary 12, four vertically extending side boundaries 14, and a bottom boundary 16. The retort is formed by a horizontal free face system in which formation is excavated from within the proposed retort boundaries to form at least one void extending horizontally across one or more levels of the retort site, leaving zones of unfragmented formation within the retort site above and below each horizontal void. The formation of an in situ oil shale retort using the horizontal free face system is described in application Ser. No. 929,250 filed on July 31, 1978 in the name of Thomas E. Ricketts, titled "METHOD FOR EXPLOSIVE EXPANSION TOWARD HORIZONTAL FREE FACES FOR FORMING AN IN SITU OIL SHALE RETORT," and assigned to the same assignee as this application, which application is hereby incorporated herein by this reference.

For clarity of illustration, each horizontal void is depicted in FIG. 1 as a generally rectangular box having an open top and a hollow interior. Dependent upon the dimensions of the void and the physical characteristics of the oil shale formation, one or more pillars of unfragmented formation may be retained within each void to provide temporary roof support. The pillars are shown as generally rectangular boxes inside the voids in FIG. 1.

In the embodiment exemplified in FIGS. 1 and 2, a portion of the formation within the retort site is excavated on an upper level to form an open base of operations 18. The floor of the base of operations 18 is spaced above the top boundary 12 of unfragmented formation of the retort being formed, leaving a horizontal sill pillar 20 of unfragmented formation between the floor of the base of operations and the top boundary of the retort being formed. The horizontal cross-sectional area of the base of operations is sufficient to provide effective access to substantially the entire horizontal cross-sectional of the retort being formed. The base of operations provides access for drilling and loading of the explosives used to subsequently explosively expand unfragmented formation toward the voids excavated from within the retort site.

For purposes of illustrating the invention herein, three vertically spaced apart horizontal voids are excavated within the retort site. It is understood that, dependent upon a variety of factors well understood by those skilled in the art, such as retort height and the mechanical characteristics of the oil shale in the formation, any number of voids may be so excavated. The upper void 22 is excavated at a level spaced vertically below the base of operations 18, leaving an upper zone 24 of unfragmented formation between the top boundary 12 of the retort being formed and the roof of the upper void. An intermediate void 26 leaves an intermediate zone 28 of unfragmented formation extending across the retort site between the floor of the upper void and the roof of the intermediate void. In the embodiment shown, the horizontal cross-sectional area within the side boundaries of the intermediate void is similar to that of the upper void and the intermediate void is directly below the upper void. A production level void 30 is excavated at the bottom of the retort, leaving a lower zone 32 of unfragmented formation extending horizontally across the retort site between the floor of the intermediate void and the roof of the production level void. The upper, intermediate and production voids can preferably occupy a combined total of between about 15% and about 25% of the total volume of formation within the retort being formed.

In a working embodiment, the vertical distance between the top boundary 12 of unfragmented formation and the bottom boundary 16 of the unfragmented formation was about 270 feet. The height of the upper void and of the intermediate void was about 36 feet, and the height of the production level void was about 25 feet. The height of the upper zone of unfragmented formation 24 was about 35 feet, the thickness of the intermediate zone 28 of unfragmented formation was about 70 feet and the height of the lower zone 32 of unfragmented formation was about 60 feet. The upper and intermediate voids were about 160 feet wide and 160 feet long, and the lower production level void 30 was about 100 feet wide and 100 feet long. The height of the sill pillar 20 was about 50 feet, and the height of the base of operation 18 was about 15 feet.

One or more pillars may, if necessary or desirable, be left within each of the horizontal voids for providing temporary roof support for the zone of unfragmented formation overlying each void. Each support pillar comprises a column of unfragmented formation integral with and extending between the roof and the floor of the horizontal void. Formation can be excavated to provide pillars in a variety of configurations. For example, they may be similar to islands in which all side walls of the pillars are spaced horizontally from corresponding side walls of formation adjacent the void, or formation can be excavated to provide pillars similar to peninsulas in which one end of the pillar is integral with a side wall of formation adjacent the void, while the remaining side walls of the pillars are spaced horizontally from the corresponding side walls of formation adjacent the void. As exemplified in FIGS. 1 and 2, the base of operation 18 includes a pair of laterally spaced apart, substantially parallel, support pillars 34 extending most of the length of the base of operations. Each pillar 34 is similar to a peninsula, with one end of such a pillar being integral with a side wall of formation adjacent the base of operations 18, a generally E-shaped void space within the base of operations 18. In a working embodiment, each support pillar 34 was about 16 feet wide and about 140 feet long, and the support pillars were spaced apart by a distance of about 44 feet.

The upper void 22 illustratively includes one large support pillar 36 of generally rectangular horizontal cross-section located centrally within the upper void. The pillar 36 is similar to an island, with all side walls of the pillar being spaced from corresponding side walls of formation adjacent the upper void, forming a generally rectangular peripheral void space surrounding all four side walls of the support pillar. In a working embodiment, the support pillar in the upper void was about 70 feet wide and about 116 feet long.

The intermediate void 26 illustratively includes a pair of laterally spaced apart, substantially parallel, support pillars 38, which extend a major part of the width of the void. These pillars are similar to islands in that a void space surrounds the entire periphery of each pillar. In a working embodiment, the support pillars 38 in the intermediate void were about 36 feet wide and about 112 feet long, and adjacent inside walls of the pillars were spaced apart by a distance of about 45 feet. About 24 feet of void space was provided between the ends of each pillar and the adjacent end walls of the formation at the edges of the intermediate void. About 24 feet of void space was left between the outside wall of each pillar and the adjacent side wall of formation at the edge of the void. The excavated volume of the upper void is about the same as the excavated volume of the intermediate void so that formation expanded toward such voids has the same void volume into which to expand. This promoted uniformity of void fraction distribution.

The production level void 30 includes by way of example, a pair of laterally spaced apart, substantially parallel, support pillars 40 extending a major part of the width of the production level void. The support pillars 40 are similar to peninsulas, forming a generally E-shaped void space within the lower void. The ends of the pillars in the lower void are integral with the rear wall of the lower void, as the retort is viewed in FIG. 1. In a working embodiment, the support pillars in the lower void were about 70 feet long and about 20 feet wide. The inside walls of the pillars were spaced apart by about 20 feet, and the outside wall of each pillar was spaced about 20 feet from the adjacent side wall of formation at the edge of the lower void.

The base of operations 18 and the upper and intermediate excavated voids each provide an open floor space vertically above at least a portion of a pillar present in the next lower excavated void. They each also provide an access region for drilling vertical blastholes through the pillar or pillars into the zone of unfragmented formation below the pillar or pillars.

As best shown in FIG. 2, a plurality of mutually spaced apart vertical blastholes 42, 44 and 46 are drilled in rows from the base of operations 18 and the upper and intermediate excavated voids into the zones of unfragmented formation 24, 28 and 32. The rows of blastholes are substantially parallel to one another and are spaced apart from one another from the front to the rear and from row to row to form a symmetrical pattern comprising a matrix or array of blastholes across the retort.

Blasting toward each horizontal void is provided by explosively expanding a zone of formation upwardly and downwardly toward each void across the entire width of such a void. Placement of explosive charges in the blastholes is best understood with reference to FIG. 2. To more clearly illustrate placement of explosive and stemming in the blastholes, the blastholes are shown out of proportion, i.e., the diameter of the blastholes is actually much smaller in relation to the horizontal dimensions of the retort than is shown in FIG. 2. In a working embodiment, the entire upper zone 24 of unfragmented formation was explosively expanded downwardly toward the upper void 22 and approximately the upper half of the intermediate zone 28 of formation below the floor of the upper void was expanded upwardly toward the upper void. Similarly, approximately the lower half of the intermediate zone of unfragmented formation above the roof of the intermediate void 26 was explosively expanded downwardly toward the intermediate void while the upper portion 32 of the lower zone of unfragmented formation was explosively expanded upwardly toward the intermediate void. The lower portion 32 of the lower zone of unfragmented formation was explosively expanded downwardly toward the lower production level void 30.

Approximately the lower portion of each of the short upper blastholes 42 is loaded with explosive 50 up to the lower boundary 12 of unfragmented formation, and the top portions 52 of the short upper blastholes are stemmed with an inert material such as sand or gravel. Thus, the columns of explosive in the short upper blastholes extend through approximately the upper half of the upper zone 24 of unfragmented formation. The long upper blastholes 42 which intersect pillar 36 in the upper excavated void 22 are drilled a portion of the way through the intermediate zone 28 of unfragmented formation and the bottom portion 54 of these blastholes is loaded with explosive. The intermediate portion 56 of each of these blastholes is stemmed. A separate upper column 58 of explosive is loaded above the stemming in each of the intermediate portions of these blastholes. These upper columns of explosive extend approximately through the upper half of the upper zone of unfragmented formation, i.e., for approximately the same depth as the explosive columns 50 in the short upper blastholes 42. The remaining upper portions 60 of the long upper blastholes 42, i.e., the portions which extent through the sill pillar 20, are stemmed.

The short intermediate blastholes 44 are drilled down from the upper void 22 a portion of the way through zone 28 of unfragmented formation and the bottom portion of these blastholes are loaded with explosive 62. The remaining upper portions of these blastholes are stemmed. Thus, the columns of explosive in the short intermediate blastholes extend through a portion of the intermediate zone 28 of unfragmented formation.

The long intermediate blastholes 44 are drilled down from the upper void through pillars 38 in the intermediate excavated void 26 to a level below the floor thereof and the lower portion of each of these blastholes is loaded with explosive 66. The intermediate portions 68 of these blastholes, which extend into the lower zone of unfragmented formation 28, are stemmed. An upper column 70 of explosive is loaded into each of these blastholes, and the upper portion 72 of each of these blastholes is stemmed. The bottom portions of the lower blast holes 46 are loaded with explosive and the upper portions 76 of all the lower blastholes are stemmed.

Preferably, detonation of each explosive charge is initiated at the end of the column of explosive furthest from the free face toward which the formation is to be explosively expanded. In this manner the direction of propagation of detonation through explosive will be toward the free face.

In the intermediate zone of unfragmented formation, one or more detonators are preferably placed in the center of each column of explosive for initiating detonation of such explosive upwardly toward the upper void and downwardly toward the lower void. Also preferably, the detonators are positioned at a level approximately mid-way between the lower free face of formation adjacent the upper void and the upper free face of formation adjacent the lower void. Detonation in this manner results in a better cratering effect than initiation at other points within the intermediate zone.

In each of the columns of explosive in the lower zone of unfragmented formation, detonation of explosive in the lower blastholes is preferably initiated such that the direction of propagation is upwardly toward the lower free face adjacent the intermediate void.

Explosive is also placed in the support pillars in the upper, intermediate and lower voids. Horizontally extending blastholes (not shown) can be drilled in the pillars and such blastholes are loaded with explosive in preparation for explosively expanding the pillars. A variety of arrangements of horizontal blastholes can be used depending on the size and shape of the pillars. Alternatively, the vertical blastholes drilled through the pillars can be loaded with explosive charges. Sufficient explosive is placed in the pillars to explosively expand the entire unfragmented mass of each pillar toward its respective void.

Figure 3:
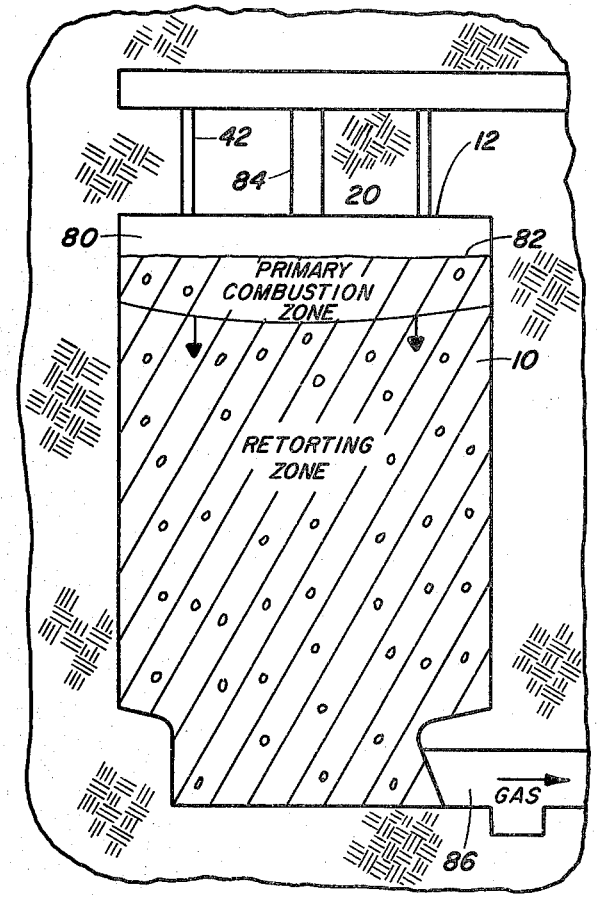
FIG. 3 is a fragmentary, semi-schematic vertical cross-sectional view of a completed in situ oil shale retort formed for operation according to principles of this invention.

The technique for creating an inlet plenum or open space above the fragmented mass in the retort comprises detonating the explosive in the unfragmented formation above the upper void 22 a short time before detonating the explosive in the unfragmented formation below the upper void so that the unfragmented formation above the upper void is expanded a greater amount and for a longer time than the unfragmented formation below the upper void. Formation from the upper zone 24 does not bulk or expand enough to fill the available space and thus leaves an inlet plenum 80 as illustrated in FIG. 3. It is understood, of course, that if any pillars are present in the upper void these will be detonated first.

The time interval between detonation of the explosive in the zone above the upper void which explosively expands that zone downwardly into the upper void and the detonation of the explosive in the upper portion of zone 28 which explosively expands that zone upwardly into the upper void is dependent upon a variety of factors such as the energy in the explosive used, the amount of explosive in each blasthole, the spacing of the blastholes and the depth of burial of the explosive, etc. The delay should be at least about 50 milliseconds, preferably the delay is from about 50 to about 500 milliseconds and most preferably from about 50 to about 150 milliseconds.

In a working embodiment, the explosive in the pillars was initially detonated. After a time interval of about 50 to about 150 milliseconds, the explosive charges in the upper zone 24 of unfragmented formation was detonated and after an additional 50 to 150 milliseconds, the explosive below the upper void 22 was detonated. Additional time is allowed for expansion of the upper zone 24 of unfragmented formation as compared with the time allowed for expansion of unfragmented formation below the upper void 22. The additional time is allowed for expansion of unfragmented formation of upper zone 24 so that such unfragmented formation expands a greater distance than the unfragmented formation below the upper zone. The formation from the upper zone does not bulk enough to fill the available space thereby forming an empty volume 80 in the retort below the top boundary 12 of unfragmented formation. Substantially the entire upper surface of the fragmented permeable mass is separated from the top boundary or sill pillar of unfragmented formation 20 by the inlet plenum void.

FIG. 3 illustrates a retort which has been formed containing a fragmented permeable mass 10 of formation particles containing oil shale, and having an inlet plenum 80 between the upper boundary 82 of the fragmented permeable mass and the lower boundary of unfragmented formation 12.

Further steps are required to prepare the retort for the retorting operation; such steps include drilling a gas inlet passage 84 downwardly from the base of operations 18 through the bottom of the sill pillar 20, so that an oxygen-supplying gas can be introduced into the retort during the retorting operation. Alternatively at least a portion of the upper blastholes 42 through the sill pillar 20 can be used for introduction of the oxygen-supplying gas. One or more separate horizontally extending product withdrawal drifts 86 extend away from a lower portion of the unfragmented permeable mass at a lower level of the retort, for removal of liquid and gaseous products from retorting.

OPERATION OF THE IN SITU OIL SHALE RETORT

During an ignition period preceding retorting operations, a primary cobustion zone is established near the upper boundary 82 of the fragmented permeable mass. A retort inlet mixture comprising fuel and at least sufficient oxygen for combustion of the fuel is introduced into the retort for establishing a secondary combustion zone, thereby increasing the rate of lateral spreading of the primary combustion zone across the fragmented permeable mass. During a first period of time, the temperature of the top boundary 12 of unfragmented formation above the inlet plenum void is maintained sufficiently low to avoid thermal sloughing. After the ignition period, the fuel can be discontinued while continuing the introduction of oxygen-supplying gas for sustaining and advancing the primary combustion zone downwardly through the fragmented permeable mass. Liquid and gaseous products of retorting are withdrawn from the lower portion of the fragmented permeable mass on the advancing side of the retorting zone. For a second period of time, which period of time is generally after completion of retorting operation, the temperature of the inlet plenum void 80 is substantially increased. The increase of the temperature of the inlet plenum void 80 causes the temperature of the top boundary 12 of unfragmented formation to increase to a temperature which will cause thermal sloughing of the sill pillar into the inlet plenum void 80 thereby providing mechanical support for the overlying formation.

As used herein, the term "primary combustion zone" refers to a portion of the retort where the greater part of the oxygen in the retort inlet mixture that reacts with the residual carbonaceous material in the retorted oil shale is consumed. As used herein, the term "retorting zone" refers to the portion of the retort where kerogen in oil shale is being decomposed to liquid and gaseous products. As used herein, the term "secondary combustion zone" refers to that portion of the retort where fuel in a retort inlet mixture is consumed. As used herein, the term "oxygen-supplying gas" refers to oxygen, air enriched with oxygen, an air and fuel mixture, air mixed with a diluent such nitrogen, off gas from an in situ oil shale retort, or steam, and mixtures thereof.

To establish a primary combustion zone near the upper boundary 82 of the fragmented permeable mass near the bottom of the gas inlet 84, carbonaceous material in the oil shale is ignited by any known method as, for example, the methods described in U.S. Pat. No. 3,952,801 or U.S. Pat. No. 3,661,423, both of which are incorporated herein by this reference. U.S. Pat. No. 3,952,801, for example, describes a technique whereby a gas-air burner is lowered into the gas inlet passage. Fuel and an oxygen-containing gas are introduced to the burner, the gas mixture ignited, and the flame directed downwardly toward the top of the fragmented permeable mass, heating an upper portion of the fragmented permeable mass to above the self-ignition temperature of oil shale.

The burner can be used for about 24 hours to heat a portion of the fragmented permeable mass to above the self-ignition temperature of carbonaceous material in oil shale. The burner is removed and a retort inlet mixture containing fuel and an oxygen-supplying gas having at least sufficient oxygen for combustion of the fuel is introduced through the gas inlet 84. The retort inlet mixture has a spontaneous ignition temperature less than the temperature of the top portion of the fragmented permeable mass which has been heated by the burner. A secondary combustion zone is thereby established in the top portion of the fragmented permeable mass.

The inlet plenum void 80 enhances uniform gas distribution and enables gas to spread rapidly through the top portion near the upper boundary 82 of the fragmented permeable mass. The secondary combustion zone therefore propagates laterally more rapidly than if the fragmented permeable mass were in tight engagement with the top boundary 12 of unfragmented formation. To at least some extent, the rate of the lateral spreading of the primary combustion zone is further enhanced by the elevated temperature in the secondary combustion zone. Such elevated temperatures reduce the mass flow rate of gas through the secondary combustion zone, and promote increased mass flow rate of gas in cooler regions. This occurs for several reasons, including reduction of void fraction in the heated portion of the fragmented mass due to thermal expansion of the particles, increased gas viscosity and increased volumetric flow rate due to gas expansion. Pressure drop, however, is the same both across the region heated by the secondary combustion zone and across the adjacent cooler regions. Since the pressure drop is similar, the effective volumetric flow rate will be similar. Thermal expansion of the gas flow causes the mass flow rate to be lower in the high temperature regions for similar volumetric flow rate. This reduction in mass flow rate of gas through the secondary combustion zone and increase in mass flow rate of gas in the cooler regions increases the rate of lateral spreading of the primary combustion zone and decreases its rate of downward advance.

The inlet plenum void 80 can have an average height of as little as about one foot across the entire fragmented permeable mass if precautions are taken to prevent thermal sloughing of the unfragmented sill pillar 20. That is, if a relatively narrow inlet plenum void 80 is desired, care should be taken during start-up to prevent heat from the burners retorting the shale oil in the bottom of the unfragmented sill pillar. If this were to occur, it could weaken the unfragmented sill pillar, causing portions of it to collapse and thereby close the void. Methods of preventing thermal sloughing are well known to those skilled in the art, such as implanting the operational end of the burners in the rubblized mass to thereby direct the flame and heat therefrom downward into the rubblized mass and away from the sill pillar, and introducing a stream of cooling fluid such as air into the inlet plenum void during ignition and at least a portion of the retorting process to cool and maintain the structural integrity of the bottom of the sill pillar. It is important that the height of the retort plenum void be optimized; that is, the void should only be large enough to allow rapid spreading of the retort inlet mixture, thereby increasing the rate of lateral spreading of the primary and secondary combustion zones.

Although this invention has been described in considerable detail with reference to certain versions thereof, other versions are within the scope of this invention. For example, although the drawings show a retort where there is a sill pillar above the fragmented mass, this invention is also useful for retorts not having a sill pillar, that is, where overlying unfragmented formation extends to the ground surface or where the burners for ignition are introduced from the side of the retort. Because of variations such as this, the spirit and scope of the appended claims should not necessarily be limited to the description of the preferred versions contained herein.

What is claimed is:

1. A method for recovering liquid and gaseous products fron an in situ oil shale retort formed in a retort site in a subterranean formation containing oil shale, the retort having a top boundary of unfragmented formation and containing a fragmented permeable mass of formation particles containing oil shale wherein substantially all of the upper surface of the fragmented permeable mass is separated from the unfragmented formation above the retort by an inlet plenum void, comprising steps of:

(a) excavating formation from within the retort site for forming at least one void extending horizontally across the retort site, leaving an upper zone of unfragmented formation within the retort site immediately above the void, and leaving a lower zone of unfragmented formation within the retort site immediately below the void, (b) placing explosive in spaced-apart vertical blastholes in the upper zone of unfragmented formation, and in vertical blastholes in the lower zone of unfragmented formation;

(c) initiating detonation of explosive in the blastholes in the upper zone of unfragmented formation to explosively expand the upper zone downwardly into the void, (d) thereafter initiating detonation of explosives in the blastholes in the lower zone of unfragmented formation to explosively expand the lower zone upwardly into the void, the time delay between detonation of the explosive in the upper zone and the detonation of explosive in the lower zone being sufficient to permit the unfragmented formation above the void to expand a greater amount and for a longer time then the unfragmented formation in the lower zone;

(e) establishing a retorting zone in an upper portion of the fragmented mass;

(f) introducing a retorting gas into the fragmented mass for sustaining the retorting zone and for advancing the retorting zone through the fragmented mass; and (g) withdrawing liquid and gaseous products of retorting from a lower portion of the fragmented mass on the advancing side of the retorting zone.

2. A method for forming an in situ oil shale retort in a subterranean formation containing oil shale, the retort having a top boundary of unfragmented formation and containing a fragmented permeable mass of formation particles containing oil shale wherein substantially all of the upper surface of the fragmented permeable mass is separated from the top boundary of unfragmented formation by an inlet plenum void, the method comprising the steps of:

(a) excavating formation from within the retort site for forming at least one void extending horizontally across the retort site, the void having a substantially horizontal roof and floor, leaving an upper zone of unfragmented formation intermediate the top boundary of the retort and the roof of the void and a lower zone of unfragmented formation below the floor of the void;

(b) forming spaced apart vertically extending blastholes in the upper and lower zones of unfragmented formation;

(c) placing explosive in the blastholes;

(d) initiating detonation of explosive in the blastholes in the upper zone of unfragmented formation to explosively expand the upper zone downwardly into the void; and, (e) thereafter initiating detonation of explosive in the blastholes in the lower zone of unfragmented formation to explosively expand the lower zone upwardly into the void, the time delay between detonations of the explosive in the upper zone and the detonation of the explosive in the lower zone being sufficient so that the unfragmented formation in the upper zone is expanded a greater amount and for a longer time than the unfragmented formation in the lower zone.

3. A method for forming an in situ retort as defined in claim 2 wherein the detonation of explosive in the blastholes in the upper and lower zones of unfragmented formation is initiated remote from the void.

4. A method for forming an in situ retort as defined in claim 2 wherein the time delay between initiation of the detonation of explosive in the upper zone of unfragmented formation and the initiation of the detonation of explosive in the lower zone of unfragmented formation is at least about 50 milliseconds.

5. A method for forming an in situ retort as defined in claim 2 wherein the average height of the inlet plenum void is at least one foot.

6. A method for forming an in situ oil shale retort in a retort situ within a subterranean formation containing oil shale, such an in situ oil shale retort having a top boundary of unfragmented formation and containing a fragmented permeable mass of formation particles containing oil shale, wherein substantially all of the upper surface of the fragmented permeable mass is separated from the top boundary of unfragmented formation by an inlet plenum void comprising the steps of:

excavating formation from within the retort site for forming at least one void extending horizontally across the retort site, the void having a floor and a roof and a pillar of unfragmented formation extending between the floor and roof, leaving an upper zone of unfragmented formation within the retort site immediately above the void, and leaving a lower zone of unfragmented formation within the retort site immediately below the void, the upper and lower zones of unfragmented formation providing upper and lower horizontal free faces of formation, respectively, adjacent the void;

drilling an array of blastholes in the upper zone of unfragmented formation, the pillar and the lower zone of unfragmented formation;

placing explosive charges in the blastholes; placing a detonator in the blastholes such that the direction of propagation of detonation in explosive in the upper and lower blastholes is toward the upper and lower free faces, respectively; and detonating the explosive in the blastholes in a sequence of first the pillar, then the upper zone of unfragmented formation and finally the lower zone of unfragmented formation; the time delay between detonation of the explosive in the upper zone and the detonation of explosive in the lower zone being sufficient to result in an inlet plenum void intermediate the top of the fragmented permeable mass of oil shale particles in the retort and the unfragmented formation above the retort.

7. The method as defined in claim 6 wherein the time delay between initiation of the detonation of explosive in the upper zone of unfragmented formation and the initiation of the detonation in the lower zone of unfragmented formation is at least about 50 milliseconds.

8. The method as defined in claim 6 wherein the time delay between initiation of the detonation of explosive in the upper zone of unfragmented formation and the initiation of the detonation in the lower zone of unfragmented formation is from about 50 to about 500 milliseconds.

9. A method for forming an in situ retort as defined in claim 6 wherein the detonation of explosive in the blastholes in the upper and lower zones of unfragmented formation is initiated remote from the void.

10. A method for forming an in situ retort as defined in claim 6 wherein the inlet plenum void has an average height of at least about one foot.

11. A method for forming an in situ retort as defined in claim 10 wherein a cooling fluid is introduced to the inlet plenum void during at least a portion of the retorting of the fragmented mass.

* * * * *